US006442910B1

(12) United States Patent
Ellison, Jr.

(10) Patent No.: US 6,442,910 B1
(45) Date of Patent: Sep. 3, 2002

(54) COMPOSITE BUILDING SYSTEM

(76) Inventor: Russell P. Ellison, Jr., 109 Ralston Rd., Richmond, VA (US) 23229

( * ) Notice: Subject to any disclaimer, the term of this patent is extended or adjusted under 35 U.S.C. 154(b) by 0 days.

(21) Appl. No.: 09/888,979

(22) Filed: Jun. 25, 2001

(51) Int. Cl.[7] ..... E04B 5/10

(52) U.S. Cl. ..... 52/320; 52/323; 52/324; 52/396.08

(58) Field of Search ..... 52/320, 323, 324, 52/379, 396.02, 396.04, 396.08, 407.3

(56) References Cited

U.S. PATENT DOCUMENTS

| | | | | | |
|---|---|---|---|---|---|
| 1,321,213 | A | * | 11/1919 | Johnson | 52/321 |
| 1,843,112 | A | * | 2/1932 | Denison | 52/289 |
| 2,005,958 | A | * | 6/1935 | Sereff | 52/321 |
| 2,110,110 | A | * | 3/1938 | Murch | 52/321 |
| 2,154,390 | A | * | 4/1939 | Akers | 52/220.2 |
| 4,023,324 | A | * | 5/1977 | Majeske | 52/204.591 |
| 4,058,948 | A | * | 11/1977 | Warren | 52/323 |
| 4,953,332 | A | * | 9/1990 | Galloway | 52/223.5 |
| 5,146,726 | A | * | 9/1992 | Ellison, Jr. | 52/320 |
| 5,373,675 | A | * | 12/1994 | Ellison, Jr. | 52/320 |
| 5,678,378 | A | * | 10/1997 | Ellison, Jr. | 52/320 |
| 5,802,792 | A | * | 9/1998 | Fielding et al. | 52/396.08 |

FOREIGN PATENT DOCUMENTS

| | | | | | |
|---|---|---|---|---|---|
| BE | 639834 | | * | 3/1964 | 52/320 |
| CA | 630335 | A | * | 11/1961 | 52/396.04 |
| GB | 136204 | | * | 12/1919 | 52/324 |
| GB | 1311471 | A | * | 3/1973 | 52/396.04 |

* cited by examiner

*Primary Examiner*—Carl D. Friedman
*Assistant Examiner*—Brian E. Glessner

(57) ABSTRACT

A composite building system includes open webbed joists with lower flanges aligned parallel to one another and spaced at a distance to create longitudinal block accepting channels. The channels are sized to accept standard masonry blocks. Masonry blocks and compressible spacers of a height less than the height of the masonry blocks are alternately laid in the longitudinal channels such that rows of blocks are aligned transversely across the channels thereby creating a grid-like pattern of blocks separated transversely by the joists and longitudinally by the spacers. Transverse grooves are created above the spacers and between adjacent blocks in each channel. Longitudinal troughs are created between adjacent blocks across each channel. Wire reinforcement is laid in the transverse grooves and grout is poured to fill the transverse grooves and the longitudinal troughs to form an integral steel reinforced concrete structure having a substantially planar top surface.

2 Claims, 6 Drawing Sheets

COMPOSITE BUILDING SYSTEM

FIELD OF THE INVENTION

This invention relates to building systems and specifically to a composite building system that utilizes steel joists and standard masonry blocks to form a slab.

BACKGROUND OF THE INVENTION

U.S. Pat. Nos. 5,146,726, 5,373,675, and 5,678,378 to Ellison, which are incorporated herein by reference in their entirety, describe composite building systems that include a joist having a lower flange, a plurality of masonry blocks resting on the lower flange and defining a longitudinal trough, the blocks having co-planar upper surfaces and at least one stepped upper edge, the stepped upper edges of the plurality of blocks running substantially transverse to the trough in a grid-like pattern, and flowable grout filling the stepped edges, spaces between adjacent blocks and the trough such that when the grout is cured it binds the joist reinforcement and the plurality of blocks to form an integral structure having a substantially planar upper surface.

In addition, U.S. patent application Ser. No. 09/501,503 to Ellison, filed on Feb. 9, 2000, which is incorporated herein by reference in its entirety, discloses an improved composite building system with higher strength and better fire resistance. Strength and fire resistance of the composite building system are improved over the composite building system described in U.S. Pat. No. '675 in a manner much the same as inclusion of the rebar, but without the need for the added installation step of inserting the rebar into the spaces between the blocks and the joist as described in U.S. Pat. No. '675.

While highly functional and easy to install, these composite building systems were not accepted readily by the construction industry as they required the use of a masonry block with at least one stepped edge. Although the stepped edge is easily formed in any standard masonry block by the manufacturer of the block when it is formed, or by a proper cutting device, manufacturers are reluctant to stock a non-standard masonry block. Cutting the stepped edge in the blocks also adds time and effort to what is intended to be an easy, time saving method of building a composite slab. A reinforced concrete topping would permit the use of standard masonry blocks but would add substantially to the cost and construction time.

Accordingly, an equally useful, easy, time saving method of forming a composite slab or similar structure using standard masonry blocks is needed.

Accordingly, an equally useful and structurally sound building system that eliminates the requirement for specialized masonry blocks without any diminution of the strength or fire resistive properties of the structure would be highly desirable.

SUMMARY OF THE INVENTION

The present invention provides an improved composite structural system over those described in U.S. Pat. Nos. 5,146,726, 5,373,675, and 5,678,378 and in U.S. patent application Ser. No. 09/501,503 by eliminating the need for a non-standard masonry block. According to the present invention, joists are provided with lower flanges and a series of parallel joists are laid on a support with the distance between the joists equal to or slightly greater than the length of a standard masonry block. Each adjacent pair of joists and the opposing portions of their lower flanges define a longitudinal block receiving channel. A standard masonry block is laid into each of the longitudinal block receiving channels to form a transverse row of blocks. Either solid or hollow blocks may be used to build the composite building system. When hollow blocks are used, the cores must be oriented horizontally. A compressible spacer is laid into each of the longitudinal block receiving channels and fitted snugly against the block in that channel. A second transverse row of blocks is then fitted into the longitudinal channels snugly against the spacers. As the spacers are of a height less than the height of the blocks, a transverse groove is defined by the top surface of the spacers and the side portions of the adjacent blocks that are left exposed above the spacers. Subsequent rows of spacers and blocks are added until the desired arrangement is completed. The resultant arrangement is a grid-like pattern of blocks separated transversely by the joists and longitudinally by the spacers. A wire reinforcement is then disposed within each transverse groove. Flowable grout is poured into the spaces between the blocks, including into the troughs and into the transverse grooves, and allowed to cure thereby forming a composite building structure with a co-planar upper surface.

Therefore, according to this invention, an equally useful and structurally sound building system is created that eliminates the requirement for specialized masonry blocks or a concrete topping and preserves the strength of the structure.

These and other advantages will become apparent when reading the attached detailed description of the invention while referring to the attached drawings and the appended claims.

TABLE OF NOMENCLATURE

| Part Number | Description |
|---|---|
| 20 | composite building system |
| 22 | block accepting channel |
| 24 | back of composite structure |
| 26 | front of composite structure |
| 28 | transverse groove |
| 30 | joist |
| 31 | upper chord |
| 32 | lower chord |
| 33 | bar (of upper chord) |
| 34 | bar (of upper chord) |
| 35 | web member |
| 36 | lower flange |
| 137 | point of attachment of web member to upper chord |
| 38 | point of attachment of web member to lower chord |
| 40 | compressible spacer |
| 41 | top surface (of spacer) |
| 42 | side surface (of spacer) |
| 43 | end (of spacer) |
| 50 | masonry block |
| 51 | side (of block as made) |
| 52 | top (of block as made) |
| 53 | end (of block as made) |
| 54 | core |
| 55 | face shell |
| 60 | wire reinforcement |
| 70 | support |
| 80 | grout |
| 82 | longitudinal trough |
| 84 | open area between bars |
| 101 | first transverse row of blocks |
| 102 | second transverse row of blocks |
| 103 | third transverse row of blocks |
| 105 | fifth transverse row of blocks |

DETAILED DESCRIPTION OF THE INVENTION

Figure 1:
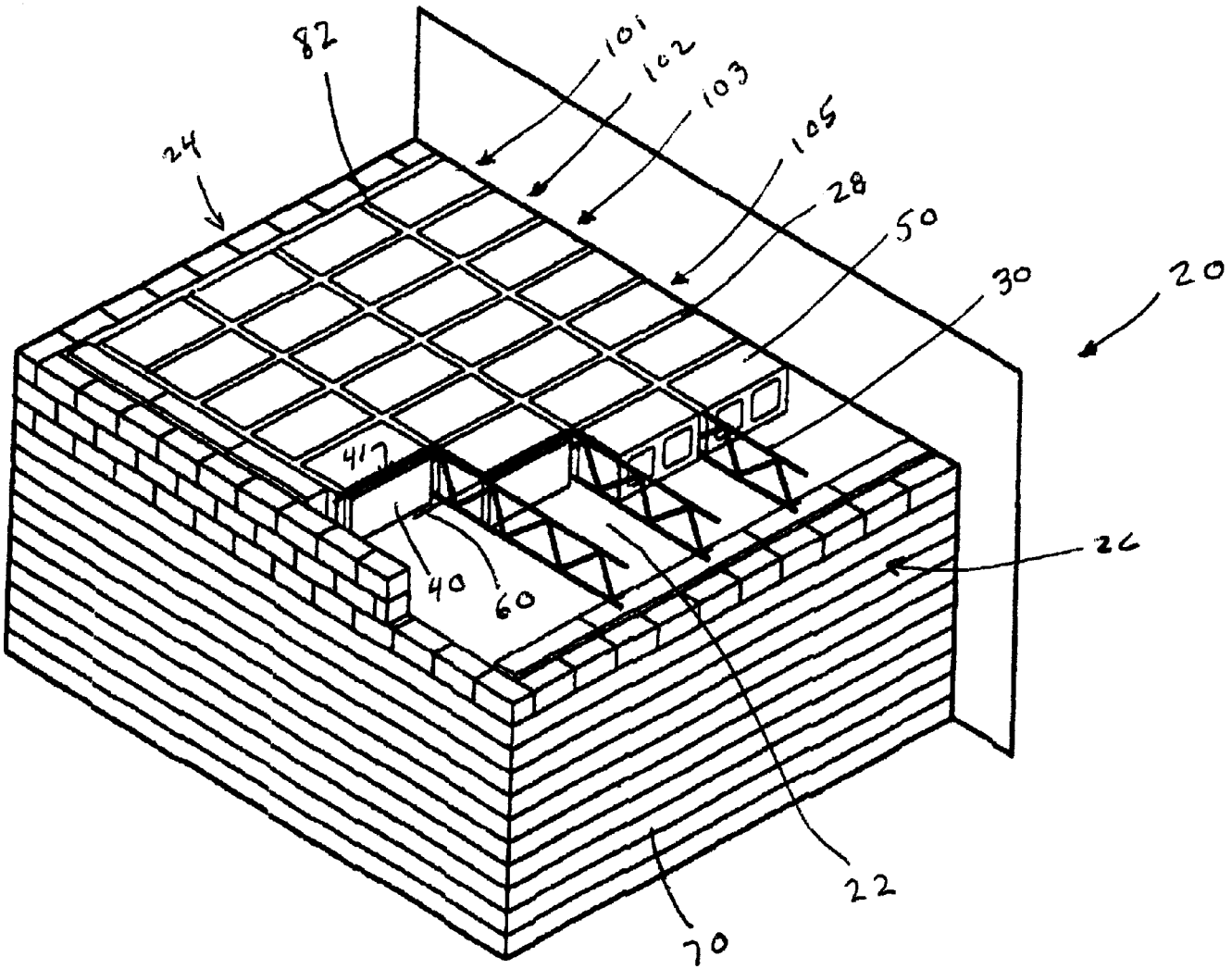
FIG. 1 is a perspective view, partially cut away, showing a composite building system according to the present invention used to create a floor slab that is illustrated on a support.

Referring to FIG. 1, a composite building system according to the present invention is generally referred to by the numeral 20. Although FIG. 1 illustrates how the composite building system 20 can be used to build a floor slab, it can easily be used to form a roof or similar structure. The system is a composite of readily accessible and easily worked materials including joists 30, standard masonry blocks 50, compressible spacers 40, wire reinforcement 60, and grout (not shown in FIG. 1).

Figure 2:
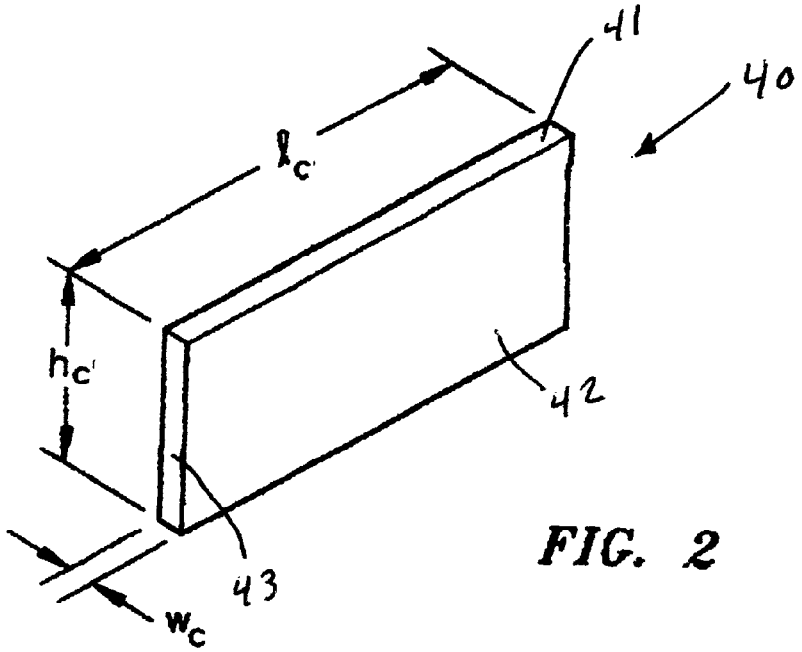
FIG. 2 is a perspective view of a compressible spacer used in the composite building system and floor slab illustrated in FIG. 1.

A compressible spacer 40, depicted in FIG. 2, is shown with a top surface 41, a side surface 42, and an end 43. The compressible spacer 40 is preferably constructed of a non-combustible and somewhat compressible material. Compressibility of the spacer will assure a uniformity of width of groove and increases the friction between the block and the spacer. The friction resists the tendency of the lighter weight spacers to float during the grouting process. High temperature industrial mineral fiber board is the preferred material of construction for the spacers. Other materials, such as polystyrene bead board or plywood would be acceptable substitutes when combustibility is not a concern.

Figure 3:
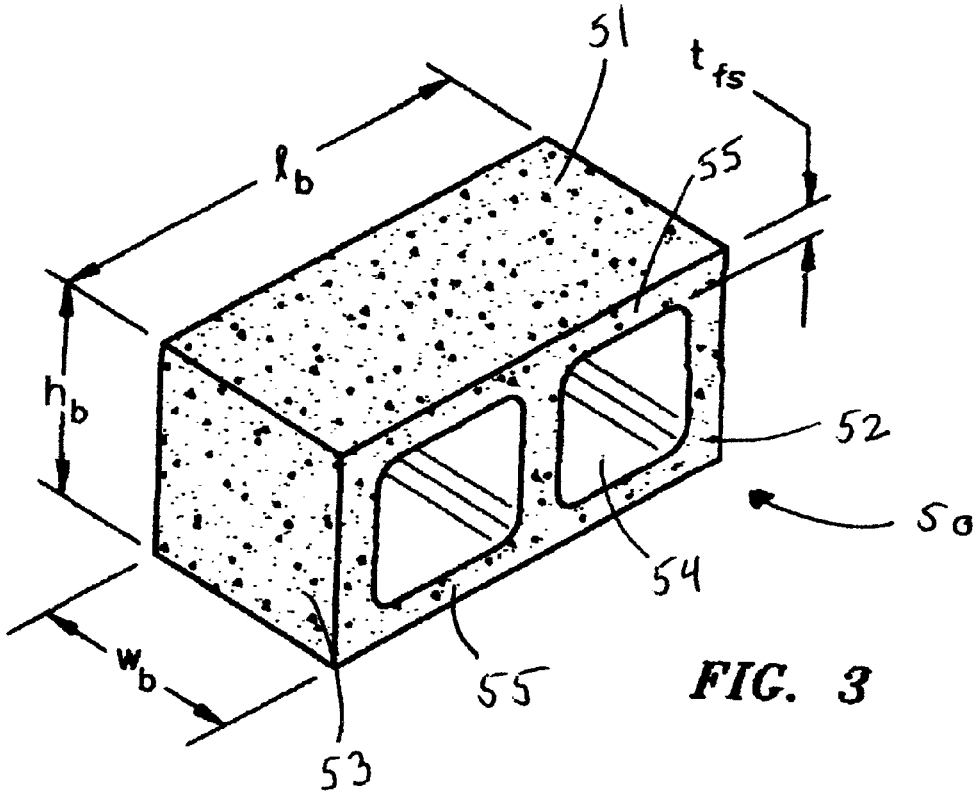
FIG. 3 is a perspective view of a masonry block laid on its side used in the composite building system and floor slab illustrated in FIG. 1.

Referring now to FIG. 3, a standard masonry block 50 is depicted laid on one of its sides 51. Since most standard masonry blocks are used in walls with the cores 54 vertical, industry terminology labels the side 51 of the block as shown in FIG. 3. When used in the present invention, a composite building structure, the upper side 51 of the standard block 50 in FIG. 3 will become a portion of the top planar surface of the composite structure. The blocks used to practice this invention may have flat ends 53 as shown in FIG. 3, what are commonly referred to as pier blocks, or may be flanged blocks, which have concave ends. Both pier and flanged blocks are standard masonry blocks in the construction industry and either may be used to construct the composite building structure of this disclosure. For demonstration purposes in this specification, flat-sided or pier blocks 50, such as that shown in FIG. 3, will be depicted in the drawings.

Pier blocks typically are constructed in two standard sizes for the construction industry, usually referred to as 16-inch blocks and 24-inch blocks, with nominal sizes of 8×8×16 inch and 8×8×24 inch respectively. The actual dimensions of the 16-inch and 24-inch standard blocks are 7.625"×7.625"×15.625" and 7.625"×7.625"×23.625", respectively. A standard 16-inch hollow pier block 50 is depicted in FIG. 3. A standard 24-inch hollow pier block would look similar to the block of FIG. 3 but would typically contain three cores instead of two. For the purposes of this invention, the builder may construct with either 16-inch blocks or 24-inch blocks in either pier or flanged shape. Blocks can also be solid blocks. Solid blocks are especially useful as closures at the ends of each longitudinal channel.

Figure 4:
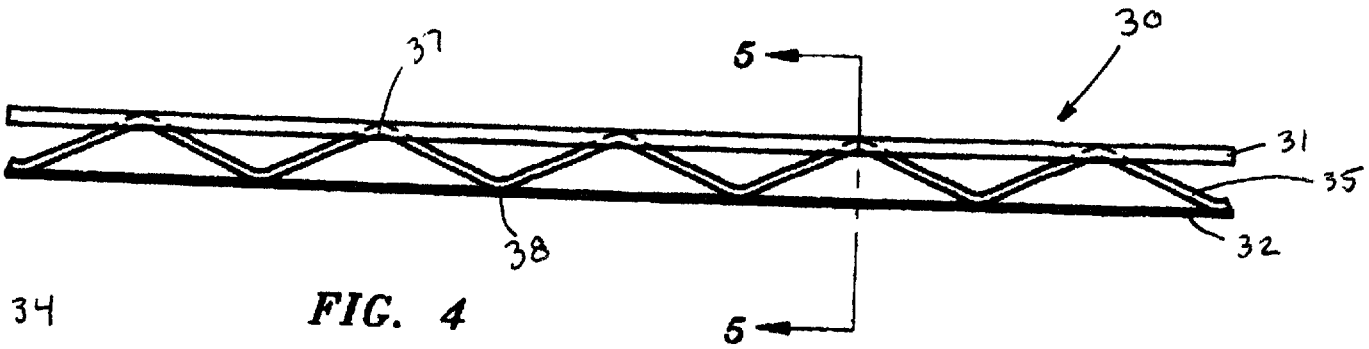
FIG. 4 is a side elevation view of a joist used in the composite building system of FIG. 1.
Figure 5:
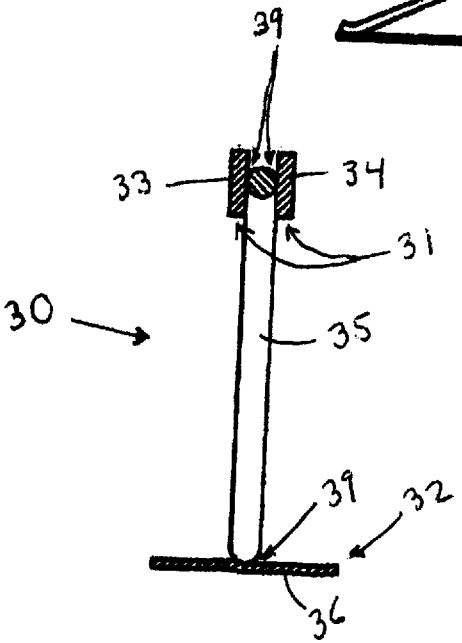
FIG. 5 is a sectional view of the joist of FIG. 4 taken along line 5—5.

Referring now to FIG. 4, a side elevation view is given of a typical joist 30 used in the composite building system. The joist 30 includes an upper chord 31 and a lower chord 32 with a web member 35 undulating between them. As shown in FIG. 5, a sectional view of the joist 30 of FIG. 4 taken along line 5—5, the upper chord 31 consists of two bars 33, 34 secured to the web member 35, and the lower chord 32 consists of a flat bar that, after being secured to the web member 35, at the flat bar's midsection, becomes a flange 36 extending outward transversely from the joist 30. As shown in FIG. 4, the web member 35 undulates between the upper chord 31 and lower chord 32 and is secured thereto. Numeral 37 in FIG. 4 denotes a typical point at which the web member 35 is secured to the upper chord 31 and numeral 38 denotes a typical point at which the web member 35 is secured to the lower chord 32. The web member 35 and chords are typically secured by welding that typically would be located at weld locations 39 shown in FIG. 5.

The present invention is a composite building system that allows the use of standard masonry blocks, such as the 16" block shown in FIG. 3. As shown in FIG. 1, joists 30 are parallel and resting on a suitable supporting structure 70. The length of a standard block determines the spacing between the joists 30. FIG. 1, and all subsequent drawings in this specification depict the use of 16-inch standard blocks. Referring to FIG. 3, the dimensions of a standard block are given as $W_b$, $l_b$, and $h_b$. A 16-inch standard block measures width ($w_b$) 7.625" by height ($h_b$) 7.625" by length ($l_b$) 15.625". Referring again to FIG. 1, the distance between the joists 30, as measured between opposing surfaces of the bars 33, 34 (shown in FIG. 5), would be equal to or slightly greater than 15.625", or the length of the 16-inch block.

Referring again to FIG. 1, the joists 30 in the composite building system 20 are spaced apart 15.625"or slightly greater, as measured between the opposing surfaces of the upper chord bars. Since the lower flange 36 of the joists 30 extend beyond the bars 33, 34 of the upper chord 31 (see FIG. 5), the area between adjacent joists 30 and above the lower flange 36 defines a longitudinal block accepting channel 22. As depicted in FIG. 1, the longitudinal block accepting channels 22 are filled, starting from one end of each longitudinal channel 22, alternately with a transverse row of 16-inch blocks 50 followed by a transverse row of compressible spacers 40. FIG. 1 depicts the composite slab structure 20 at an intermediate stage of construction, with the blocks 50 added from the back 24 of the composite structure to the front 26. In FIG. 1, numeral 101 refers to the first transverse row of blocks laid with the second transverse row of blocks 102 and third transverse row of blocks 103 as designated. After each transverse row of blocks are laid, a transverse row of compressible spacers 40 are added. A compressible spacer 40 is in view in FIG. 1 in the leftmost longitudinal channel 22 after transverse row 105. As the blocks 50 are added in a grid-like pattern, the space between transversely adjacent blocks 50 define a longitudinal trough 82.

As shown in FIG. 2, the compressible spacer 40 is of dimensions $w_c$, $l_c$, and $h_c$. A compressible spacer to be used with 16-inch standard blocks would therefore preferably measure thickness ($w_c$) 0.50" by height ($h_c$) 6.625" by length ($l_c$) 15.625". The thickness ($w_c$) of the compressible spacer 40 could however vary between approximately 0.375 and 1.000 inch and the height ($h_c$) could vary between 6.375 and 6.875 inch. When using hollow blocks, the minimum height ($h_c$) of compressible spacer 40 is limited to 6.375 inches as a consequence of the face shell 55 thickness ($t_{fs}$) (as shown in FIG. 3) on a standard block 50 being limited to 1.250 inches by code. Face shell 55 thickness $t_{fs}$ is the distance between the outer surface of the block and the nearest inner surface of the core 54. Therefore, when the composite structure is later filled with grout, if the compressible spacer 40 is less than 6.375 inches in height, grout will enter the block cores 54 and render the system inoperable.

Referring again to FIG. 1, the length of the compressible spacers 40 and blocks 50 are typically 15.625" with the block-accepting channels 22 typically 15.625" or slightly larger to accept the spacers and blocks. The typical height of a standard block 50 is 7.625". The preferred height of a spacer 40 is 6.625" and its preferred thickness is 0.50" After the standard blocks 50 and compressible spacers 40 of the preferred size are alternately laid in transverse rows into the block-accepting channels 22, a transverse groove 28 is formed above the top surface 41 of the compressible spacer 40 and between the blocks 50 that are typically 1.0 inch higher than the spacers 40. The transverse groove 28 will therefore typically measure 0.5 inch wide by 1.0 inch deep.

Referring again to FIG. 1, after the transverse grooves 28 of typical size 0.5" wide by 1.0" deep are formed, wire reinforcement 60 is laid into the transverse grooves 28. By adding the wire reinforcement 60 as shown, the structural integrity of the composite building system 20 will be enhanced tremendously in the transverse direction. The reinforcement wire 60 is typically 9 gauge, or approximately 3/16" diameter, and has a rated ultimate tensile strength of 70 Ksi (70,000 pounds per square inch). The reinforcement wires also provide a means to tie adjacent construction to the slab as explained in detail in U.S. Pat. No. '378.

Figure 6:
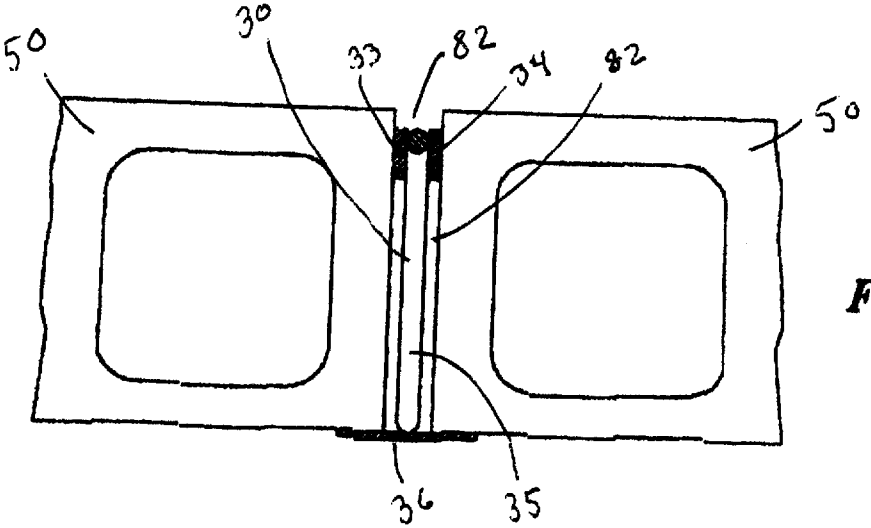
FIG. 6 is an enlarged sectional view showing two blocks supported by a joist according to the composite building system of FIG. 1.

Referring to FIG. 6, a portion of a composite building system is shown depicting sections of two blocks 50 supported by a cutaway portion of a joist 30. The joist 30 includes a lower flange 36 that extends transversely to support the blocks 50 which can butt snugly against the upper bars 33, 34 of the joist 30. After grout is applied (not shown in FIG. 6) the longitudinal trough 82 or open space between the blocks 50 will be filled with grout. An end view of the transverse groove 28 is shown in FIG. 6.

Figure 7:
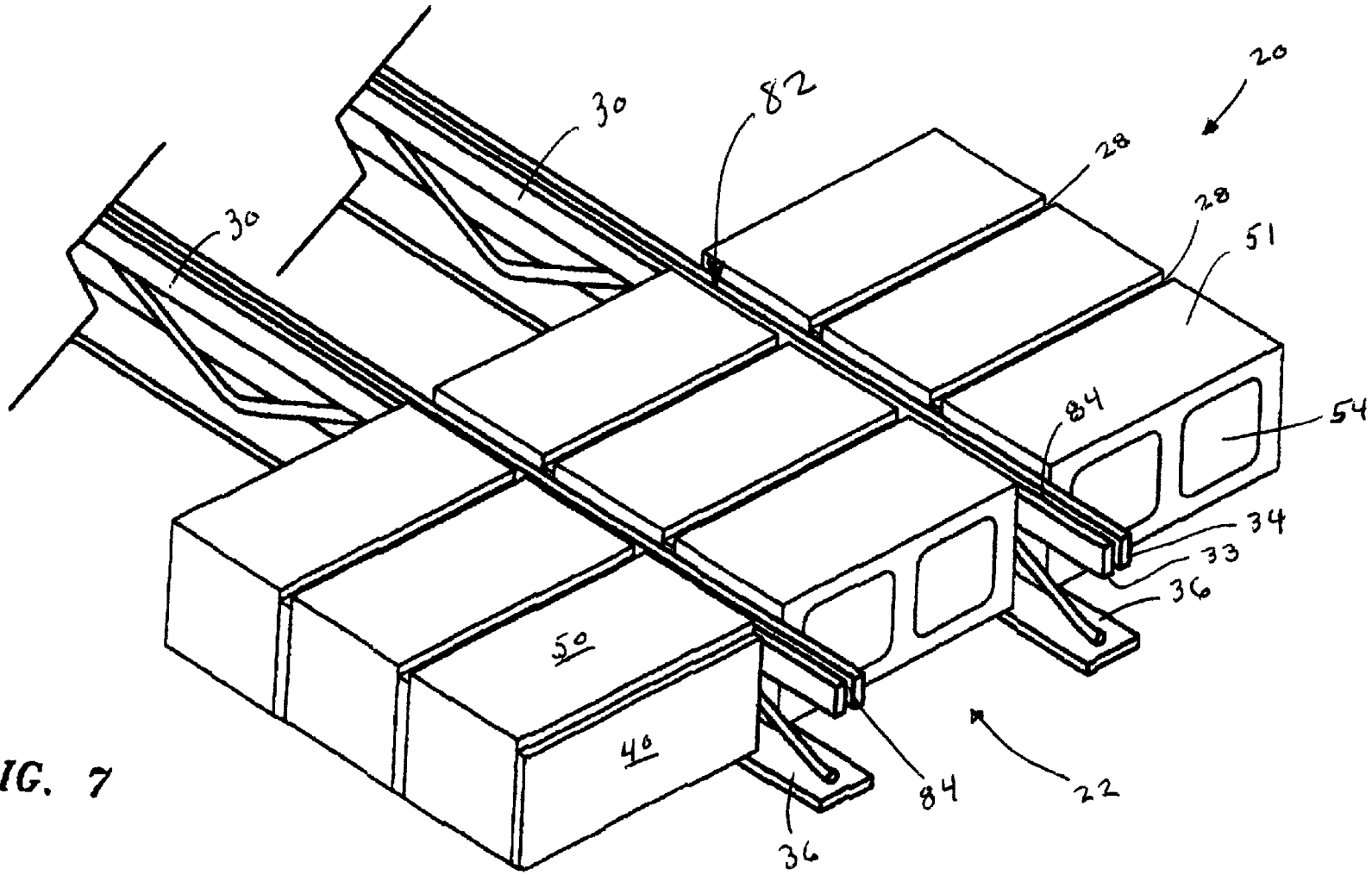
FIG. 7 is a perspective view, with the joists partially cut away, of the composite building system of FIG. 1 in an intermediate state of assembly.

FIG. 7 is a perspective view, with the joists 30 partially cut away, of the composite building system 20 of FIG. 1 in an intermediate state of assembly, prior to inserting wire reinforcement and pouring grout. The blocks 50 are shown resting on the lower flanges 36 of the joists 30 in the longitudinal block-accepting channels 22. The blocks 50 are laid on their sides 51 in the channels 22 thereby orienting the cores 54 horizontally. The bottoms of the transverse grooves 28 are formed between adjacent blocks in each channel 22 by the top surface 41 of the compressible spacers 40. Adjacent blocks 50 form the sides of each transverse groove 28. As shown in FIG. 7, the top surface of the composite building structure 20 has a substantially planar surface. An open area 84 exists between the bars 33, 34 of the upper chord 31 which will allow entry for grout to fill the longitudinal troughs 82.

Figure 8:
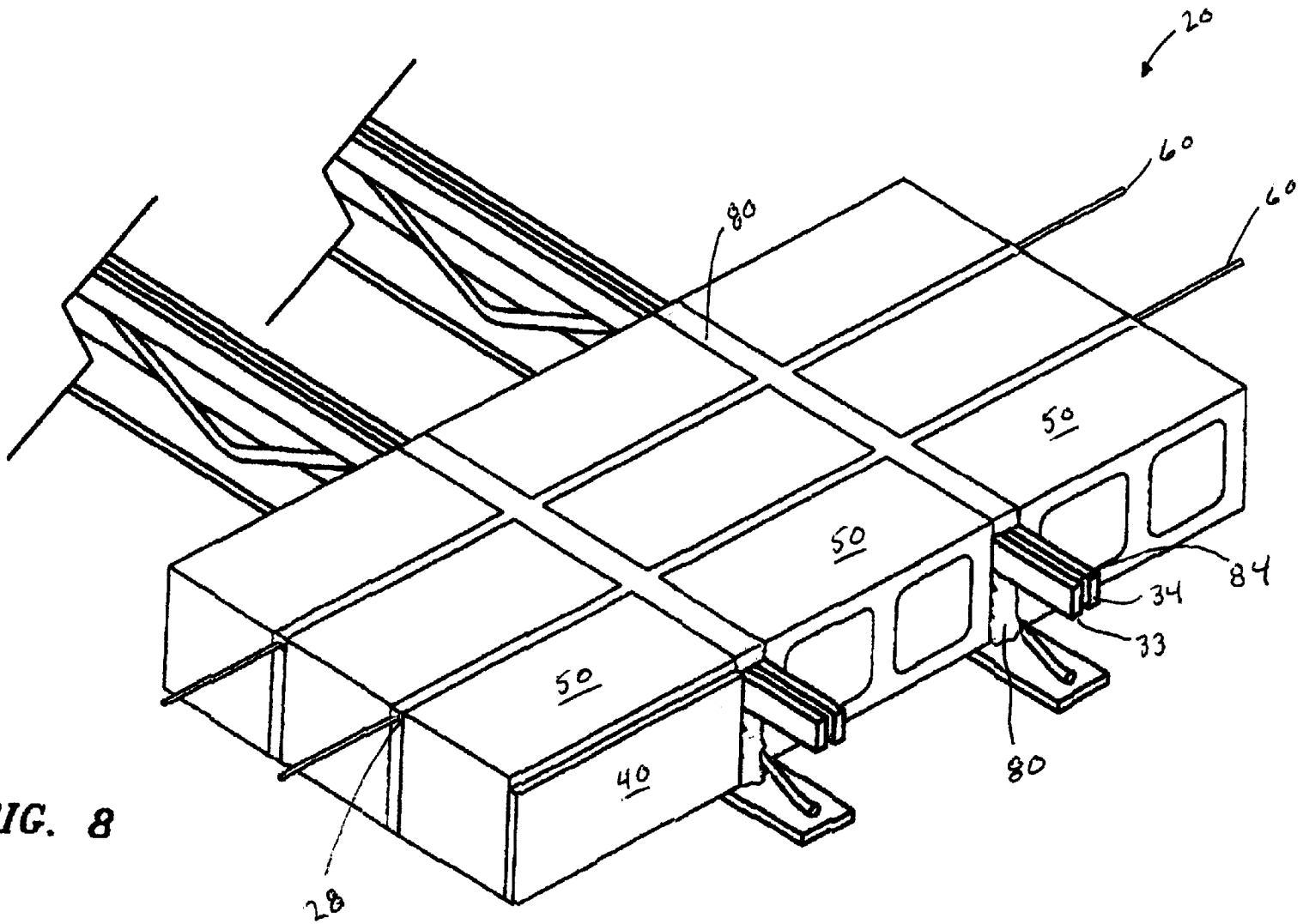
FIG. 8 is a perspective view of an incomplete structure, with the joists partially cut away, part of the grout and spacers cut away, and with some of the wire reinforcement shown extending from the transverse grooves to illustrate how the grout fills the troughs and transverse grooves.

FIG. 8 is the same perspective view as FIG. 7, but after wire reinforcement 60 has been added to the transverse grooves 28 and flowable grout 80 has been applied. As shown in FIG. 8, the grout 80 has flowed through the top bars 33, 34 of the joist 30 and filled the longitudinal troughs 82. Grout 80 has also flowed into and filled the transverse groove 28 formed above the spacer 40 and between longitudinally adjacent blocks 50 and has completely enveloped the wire reinforcement 60 disposed in the transverse groove 28. After the grout has cured, the resultant composite building system 20 is an integral steel reinforced concrete structure having a substantially planar top surface.

Figure 9:
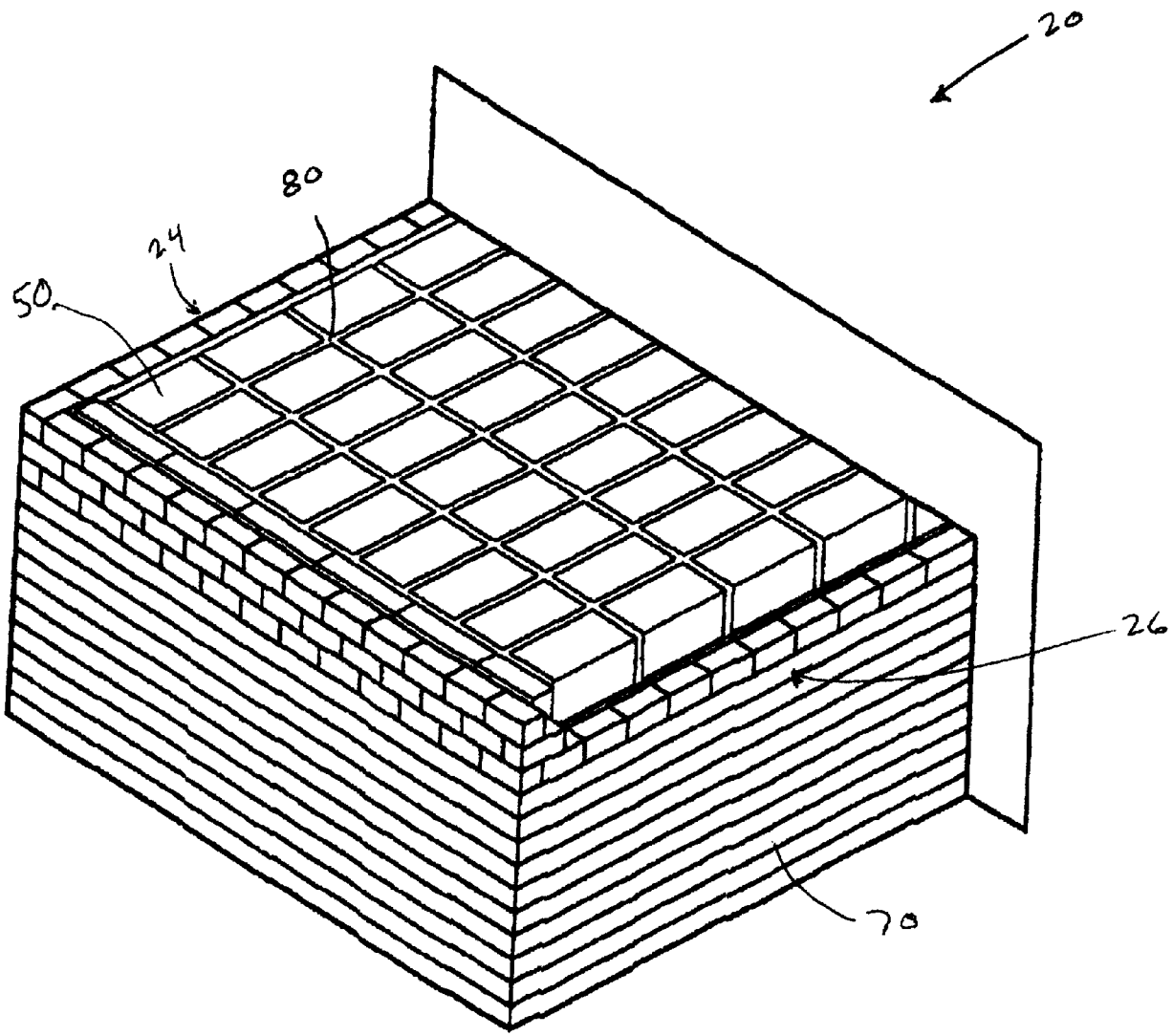
FIG. 9 is a perspective view of the completed composite building system of FIG. 1 used to create a floor or roof slab that is illustrated on a support.

FIG. 9 is a perspective view of the preferred embodiment, a completed composite building system 20 from the same perspective as FIG. 1. The composite building system 20 is a substantially planar slab with cured grout 80 filling the open areas between blocks and thereby forming an integral steel reinforced concrete structure having a substantially planar top surface.

The load carrying capacity of the composite building system constructed in this manner is equal to the capacity of the slabs described in the previous patents that were incorporated herein by reference.

Some examples of the present invention have been described in detail in this specification. It will become apparent to those skilled in the art that the present invention may be altered in many ways without departing from the spirit and scope of the invention. Thus the scope of the invention should be determined by the appended claims and their legal equivalents, rather than by the examples given.

What is claimed is:

1. A composite building system comprising:

joists supported at their ends at the same height to form a series of parallel joists, said joists having a lower flange, each of said joists spaced apart by a distance equal to or slightly greater than the length of a standard masonry block, each adjacent pair of said joists and opposing portions of said lower flanges defining a longitudinal block receiving channel;

a standard masonry block laid into each of said longitudinal block receiving channels with said masonry blocks aligned transversely and defining a first row of masonry blocks, said standard masonry blocks taller than said joists with the space between adjacent transverse blocks defining a longitudinal trough;

a compressible spacer having an upper support surface laid into each of said longitudinal block receiving channels against said first row of masonry blocks with the length of said compressible spacer approximately equal to the length of said standard masonry block, said compressible spacer being of a height lower than the height of said standard masonry block, said compressible spacer being of a thickness between approximately 0.375 inch and 1.000 inch;

a second standard masonry block laid into each of said longitudinal block receiving channels against said first row of compressible spacers defining a second transversely aligned row of masonry blocks with the distance between said first row of standard masonry blocks and said second row of standard masonry blocks and said upper support surface of said compressible spacer defining a transverse groove, said transverse groove being of a depth approximately equal to the difference between said height of said standard masonry block and said height of said compressible spacer;

a wire reinforcement disposed within said transverse grooves; and a cured grout filling said transverse grooves and said longitudinal troughs, said cured grout binding said blocks, said joists, and said wire reinforcements to form an integral concrete structure having a substantially planar upper surface.

2. A method of forming a composite building structure comprising the steps of:

providing a plurality of open-web joists, said joists having a lower flange for supporting masonry blocks thereon;

laying said plurality of open-web joists on a suitable support, said joists equidistant from and parallel to one another with the distance between adjacent joists equal to or slightly greater than the length of a standard masonry block, said adjacent joists with said lower flanges defining a plurality of adjacent longitudinal block receiving channels;

inserting a standard masonry block in each of said longitudinal block receiving channels to form a transversely aligned row of masonry blocks, said blocks inserted in said channels with the said blocks extending a short distance above the top chord of said joists;

inserting a compressible spacer in each of said longitudinal block receiving channels to form a transversely aligned row of compressible spacers, said compressible spacers fitted snugly against said masonry blocks with said compressible spacers lower than the height of said masonry blocks with said compressible spacers of a thickness between 0.375 and 1.000 inch;

continuing to alternately insert transverse rows of masonry blocks and transverse rows of compressible spacers until said longitudinal block receiving channels are filled, said filled longitudinal block receiving channels defining a grid-like masonry block arrangement having a substantially planar upper surface with transverse grooves defined by said compressible spacers interspersed between the sides of said masonry blocks and longitudinal troughs defined by the space between adjacent ends of said blocks;

inserting a wire reinforcement within each of said transverse grooves;

applying a grout to fill said transverse grooves and said longitudinal troughs; and allowing said grout to cure thereby creating a composite building structure.

* * * * *